US010550615B2

(12) United States Patent
Cherry et al.

(10) Patent No.: US 10,550,615 B2
(45) Date of Patent: Feb. 4, 2020

(54) DOOR HINGE ASSEMBLY INCORPORATING A LATCH TO FACILITATE SELECTIVE DOOR REMOVAL

(71) Applicant: FORD GLOBAL TECHNOLOGIES, LLC, Dearborn, MI (US)

(72) Inventors: Reese Cherry, Madison Heights, MI (US); Matthew B. Rutman, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 90 days.

(21) Appl. No.: 15/916,582

(22) Filed: Mar. 9, 2018

(65) Prior Publication Data

US 2019/0277074 A1 Sep. 12, 2019

(51) Int. Cl.
*E05D 5/12* (2006.01)
*E05D 7/10* (2006.01)

(52) U.S. Cl.
CPC ..... *E05D 5/128* (2013.01); *E05D 7/1005* (2013.01); *E05Y 2900/531* (2013.01); *Y10T 16/535* (2015.01); *Y10T 16/53613* (2015.01); *Y10T 16/553* (2015.01)

(58) Field of Classification Search
CPC ..... E05D 7/10; E05D 7/1005; E05D 7/1016; E05D 5/128; E05D 2015/587; Y10T 16/553; Y10T 16/5535; Y10T 16/535; Y10T 16/536; Y10T 16/53605; Y10T 16/53607; Y10T 16/536075; Y10T 16/5361; Y10T 16/53613; Y10T 16/5363; Y10T 16/5367; Y10T 16/5369
USPC ..... 16/380, 381, 254, 260, 261, 262, 263, 16/265, 266, 270, 271, 272
See application file for complete search history.

(56) References Cited

U.S. PATENT DOCUMENTS 1,030,801 A * 6/1912 Berault ..... E05D 7/1016 16/262
3,690,035 A * 9/1972 Schindlauer ..... E05D 7/1005 49/192
3,733,649 A * 5/1973 Nagy ..... E05D 7/1016 16/380

(Continued)

FOREIGN PATENT DOCUMENTS

DE 3046395 7/1982
DE 19521539 A1 12/1996
EP 0425794 A1 5/1991

*Primary Examiner* — Jeffrey O'Brien
(74) *Attorney, Agent, or Firm* — Vichit Chea; Carlson, Gaskey & Olds, P.C.

(57) ABSTRACT

An exemplary vehicle hinge assembly can include a hinge pin and a latch. The latch is configured to transition from a locked position to an unlocked position when the hinge assembly is opened in a first orientation, and is configured to stay in the locked position when the hinge assembly is opened in a second orientation different than the first orientation. The latch in the locked position blocks movement of the hinge pin from the engaged position. An exemplary securing method can include rotatably coupling a door to a vehicle body with a hinge assembly. When the hinge assembly not inverted, movement of a hinge pin of the hinge assembly from an engaged to a disengaged position is permitted. When and inverted, movement of a hinge pin from the engaged position is blocked.

5 Claims, 7 Drawing Sheets

(56) References Cited

U.S. PATENT DOCUMENTS 3,805,325 A * 4/1974 Lee ..... E05C 19/08 16/262
4,137,603 A * 2/1979 Kvasnes ..... E05D 7/1055 16/381
4,190,929 A * 3/1980 Palka ..... E05D 7/1022 16/381
4,455,711 A * 6/1984 Anderson ..... E05D 7/1011 16/229
4,570,290 A * 2/1986 Anderson ..... E05D 7/1011 16/229
4,715,090 A * 12/1987 Morris ..... E05D 7/1044 16/261
4,790,159 A * 12/1988 Quinn ..... E05D 5/128 70/232
4,800,623 A * 1/1989 Brockhaus ..... E05D 5/12 16/254
4,854,009 A * 8/1989 Brockhaus ..... E05D 5/12 16/263
4,881,298 A * 11/1989 Turnbull ..... E05D 5/062 16/266
5,259,091 A * 11/1993 Mordick ..... E05D 5/065 16/254
5,396,974 A * 3/1995 Pedlar ..... A45C 5/02 190/18 A
5,722,121 A * 3/1998 Lau ..... E05D 5/128 16/381
6,317,928 B1 * 11/2001 Guillemette ..... E05D 7/1016 16/353
6,438,800 B1 * 8/2002 Narang ..... E05D 7/1005 16/229
6,721,994 B2 * 4/2004 Bowman ..... E05D 5/023 16/262
7,325,276 B2 * 2/2008 Kim ..... E05D 5/128 16/262
7,934,782 B2 * 5/2011 Christie ..... E05D 3/022 16/361
8,464,396 B2 * 6/2013 Westby ..... E05D 5/12 16/380
8,756,761 B2 * 6/2014 Barquet ..... E05D 5/12 16/262
9,068,382 B1 * 6/2015 Hall ..... E05D 11/06
9,828,794 B2 * 11/2017 Romeu Guardia ..... E05D 3/02
10,415,282 B2 * 9/2019 Klaffke ..... E05D 3/02
2007/0089269 A1 * 4/2007 Shen ..... E05D 5/06 16/268
2011/0088217 A1 * 4/2011 Bjorn ..... E05D 5/12 16/235
2011/0162176 A1 * 7/2011 Tylaska ..... E05D 5/128 24/595.1
2016/0168893 A1 * 6/2016 Finkelstein ..... E05D 5/128 16/264
2017/0268269 A1 * 9/2017 Nicholas, III ..... E05D 5/12

* cited by examiner

DOOR HINGE ASSEMBLY INCORPORATING A LATCH TO FACILITATE SELECTIVE DOOR REMOVAL

TECHNICAL FIELD

This disclosure relates generally to a latch that can block a door of a vehicle from being removed when the vehicle is not in an upright position.

BACKGROUND

Some vehicles, especially vehicles designed for off-road usage, incorporate removable doors. Removing the doors from such vehicles can provide better access and visibility for the driver when off-roading and during other driving conditions.

Current vehicles with removable doors can incorporate fasteners on hinge pins of externally mounted hinges. The hinges couple the doors to a body of the vehicle. Removing such doors involves removing the fasteners from the hinge pins, withdrawing the hinge pins, and then removing the door from the vehicle. The fasteners add complexity. The fasteners could be misplaced when the doors are removed, which complicates reattachment of the doors.

SUMMARY

A vehicle hinge assembly according to an exemplary embodiment of the present disclosure includes, among other things, a hinge pin that, when in an engaged position, rotatably couples a door portion of the hinge assembly to a body portion of the hinge assembly. The hinge assembly also includes a latch configured to transition from a locked position to an unlocked position when the hinge assembly is opened in a first orientation. The latch is further configured to stay in the locked position when the hinge assembly is opened in a second orientation different than the first orientation. The latch in the locked position blocks movement of the hinge pin from the engaged position.

In a further non-limiting embodiment of the foregoing assembly, the latch in the unlocked position permits relative movement of the hinge pin from the engaged position to a disengaged position so that the door portion and the vehicle portion can be decoupled from each other.

In a further non-limiting embodiment of any of the foregoing assemblies, when the hinge pin is in the engaged position, the door portion is rotatable with a door about the hinge pin between open and closed positions. When the door is fully closed and the hinge assembly is not inverted, a support feature on a door side of the hinge assembly supports and holds the latch in the locked position. Moving the door from the fully closed position to an open position moves the support feature away from the latch such that the latch can transition to the unlocked position.

In a further non-limiting embodiment of any of the foregoing assemblies, the latch includes an engagement portion and a handle portion. The engagement portion is received within a groove of the hinge pin when the latch is in the locked position to prevent withdrawal of the hinge pin from an aperture of a door portion of the hinge, an aperture of a body portion of the hinge, or both.

In a further non-limiting embodiment of any of the foregoing assemblies, the latch comprises a bearing that is disposed within a cavity on a door side or a body side the hinge. The bearing falls within the cavity when the latch is inverted to a position where the bearing is received with a groove of the hinge pin.

In a further non-limiting embodiment of any of the foregoing assemblies, the latch comprises a tab. When the hinge assembly is inverted, the tab rotates about a pivot to move from the unlocked position to the locked position.

In a further non-limiting embodiment of any of the foregoing assemblies, the latch comprises an eccentric member. When the hinge assembly is inverted, the latch pivots about a pivot to move from the unlocked position to the locked position.

In a further non-limiting embodiment of the foregoing assembly, the second orientation is inverted from the first orientation.

In a further non-limiting embodiment of the foregoing assembly, a vehicle includes the vehicle hinge assembly. The first orientation corresponds to an ordinary orientation of the vehicle during operation.

A securing method according to another exemplary aspect of the present disclosure includes, among other things, rotatably coupling a door to a vehicle body with a hinge assembly. When the hinge assembly is opened and not inverted, the method permits movement of a hinge pin of the hinge assembly from an engaged to a disengaged position. When the hinge assembly is opened and inverted, the method blocks movement of a hinge pin of the hinge assembly from the engaged position.

In a further non-limiting embodiment of the foregoing method, the door can be decoupled from the vehicle body when the hinge pin is in the disengaged position.

A further non-limiting embodiment of any of the foregoing methods includes blocking movement of the hinge pin to the disengaged position using a latch in a locked position. The latch is transitioned to an unlocked position to permit movement of the hinge pin to the disengaged position.

A further non-limiting embodiment of any of the foregoing methods includes positioning an engagement portion of the latch within a groove of the hinge pin when the latch is in the locked position to prevent withdrawal of the hinge pin from an aperture of a door portion of the hinge, an aperture of a body portion of the hinge, or both.

In a further non-limiting embodiment of the method, when the hinge assembly is not inverted, the method includes rotating a door portion of the hinge assembly with the door about the hinge pin from an open position to a closed position, and, during the rotating pressing a cam of the door portion against the latch to transition the latch from the unlocked position to the locked position.

In a further non-limiting embodiment of any of the foregoing methods, when the hinge assembly is inverted, gravity urges the latch to transition to the locked position and maintains the latch in the locked position.

In a further non-limiting embodiment of any of the foregoing methods, inverting the hinge assembly causes a bearing to fall within a cavity. The bearing, after falling, is at least partially received within a groove of the hinge pin to block movement of the hinge pin from the engaged position.

In a further non-limiting embodiment of any of the foregoing methods, inverting the hinge assembly causes a tab to rotate about a pivot to a locked position where the tab is at least partially received within a groove of the hinge pin to block movement of the hinge pin from the engaged position.

In further non-limiting embodiment of any of the foregoing methods, inverting the hinge assembly causes an eccentric member to rotate about a pivot to a locked position where the eccentric member is at least partially received within a groove of the hinge pin to block movement of the hinge pin from the engaged position.

In further non-limiting embodiment of any of the foregoing methods, the hinge pin in the engaged position is received within an aperture of a door portion of the hinge assembly and an aperture of a body portion of the hinge assembly. The hinge pin in the disengaged position is withdrawn from the aperture of the door portion, the aperture of the body portion, or both.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

This disclosure relates generally to a hinge assembly that facilitates removal of a vehicle door.

The hinge assembly includes a latch that transitions between locked and unlocked positions. When the vehicle is at an orientation appropriate for removing the door, the latch is in an unlocked position to permit removal of the door. When the vehicle is in an orientation that is not appropriate for door removal, such as resting on its side or roof, the latch is transitioned to the locked position to block removal of the door. Gravity can cause the latch to transition between the locked position and the unlocked position.

Figure 1:
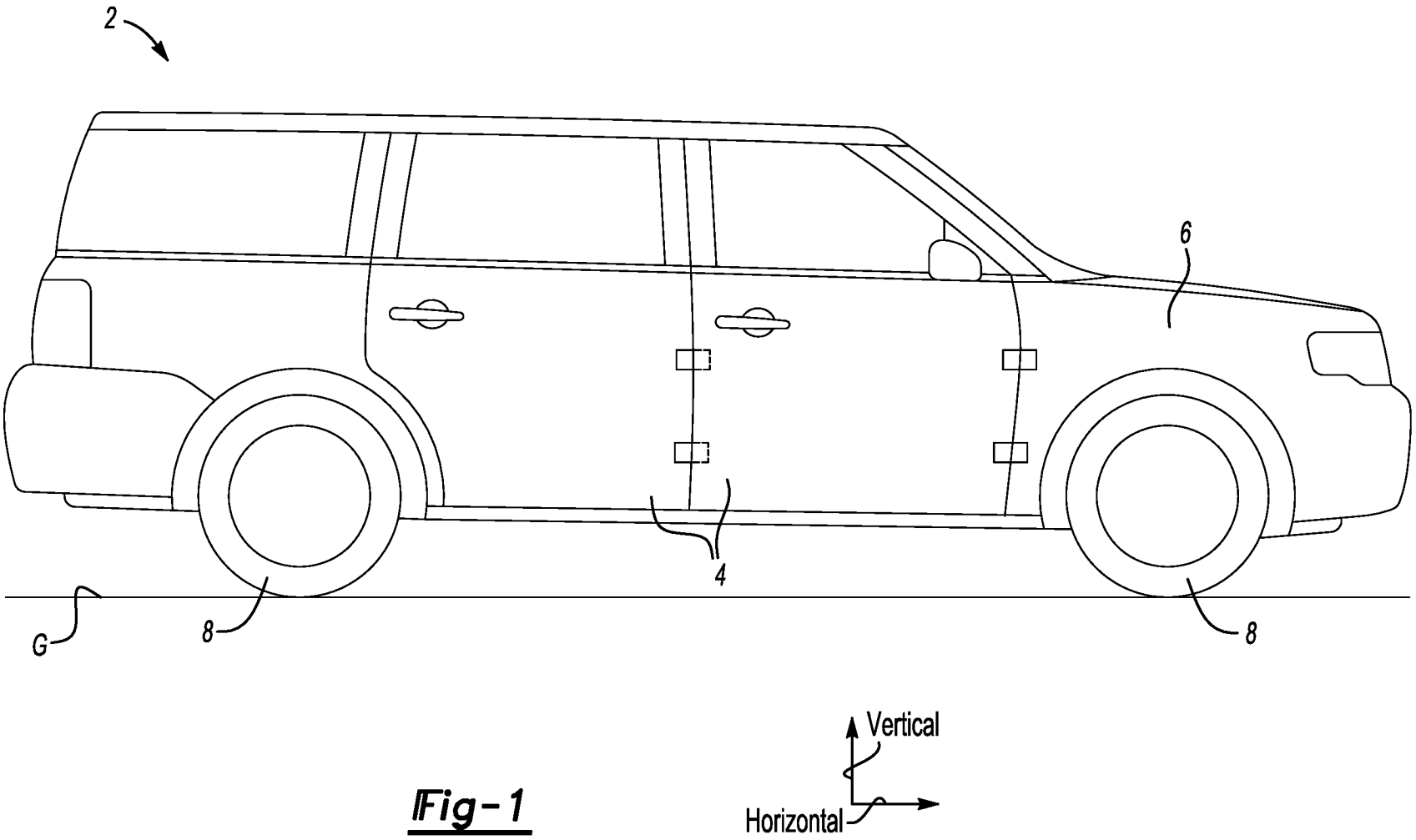
FIG. 1 illustrates a side view of an exemplary vehicle having removable side doors.

Referring to FIG. 1, a vehicle 2 includes doors 4 pivotably secured to a vehicle body 6. The doors 4 can move pivot between open and closed positions. The vehicle 2 is shown during an orientation appropriate for operation where the vehicle 2 is upright and wheels 8 rest on ground G. The doors 4 are pivotably secured to the vehicle body 6 via hinge assemblies 10.

Referring to FIGS. 2-5 with continued reference to FIG. 1, a hinge assembly 10 according to an exemplary aspect of the present disclosure includes a door portion 14, a vehicle body portion 18, a hinge pin 22, and a latch 26. The hinge assembly 10 is shown in a position corresponding to the associated door 4 being in a closed position. The door portion 14 is secured to one of the doors 4. The vehicle body portion 18 is secured to the vehicle body 6.

As the door 4 associated with the hinge assembly 10 opens, the door portion 14 rotates relative to the vehicle body portion 18 in a direction R about a longitudinal axis A of the hinge pin 22. When the hinge pin 22 is in an engaged position, the door portion 14 is pivotably coupled to the vehicle body portion 18 via the hinge pin 22. When the hinge pin 22 is in a disengaged position, the door portion 14 is pivotably decoupled from the vehicle body portion 18. Generally, the hinge pin 22 is in a disengaged position when the hinge pin 22 has been withdrawn from an aperture 28A of the vehicle body portion 18, an aperture 28B of the door portion 14, or both.

When the hinge assembly 10 is in the position of FIGS. 2-5 where the door 4 is fully closed, the latch 26 is in a locked position. The latch 26 in the locked position prevents withdrawing the hinge pin 22 from the hinge assembly 10 along the longitudinal axis A of the hinge pin 22.

Figure 4:
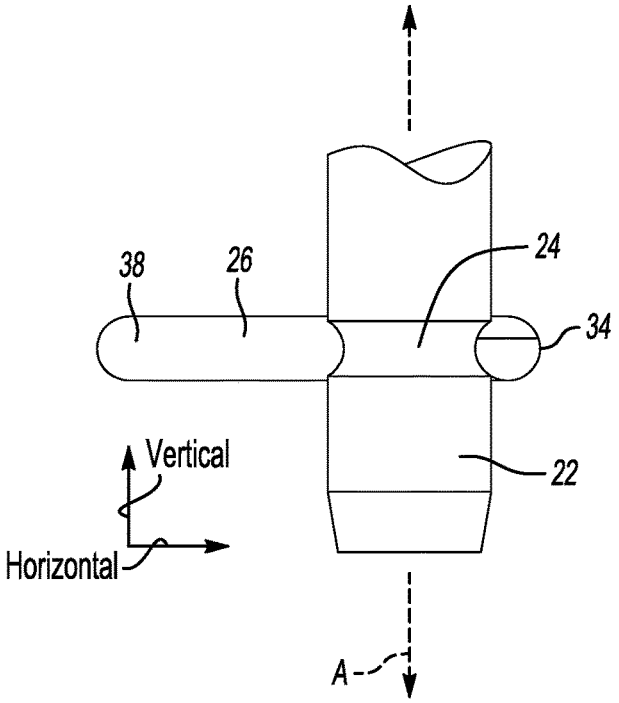
FIG. 4 illustrates a side view of a hinge pin and the latch from the hinge assembly of FIGS. 2 and 3 with the hinge assembly in the fully closed position.
Figure 5:
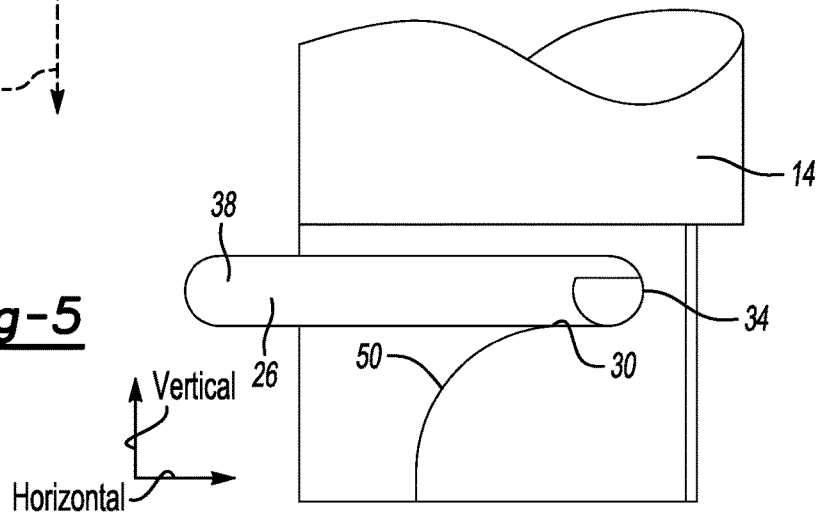
FIG. 5 illustrates a side view of a door portion and the latch from the hinge assembly of FIGS. 2 and 3 with the hinge assembly in the fully closed position and the latch in a locked position.

In the exemplary embodiment, a portion of the latch 26 fits within an annular groove 24 of the hinge pin 22 when the latch 26 is in the locked position (see FIG. 4). The portion of the latch 26 received within the annular groove 24 blocks withdrawal of the hinge pin 22 to keep the door portion 14 pivotably coupled to the vehicle body portion 18 and prevents removal of the door 4. Although described as an annular groove 24, other types of grooves and recesses are contemplated and would fall within the scope of this disclosure.

When the hinge assembly 10 is in the position of FIGS. 2-5 where the door 4 is fully closed, the latch 26 is supported by the door portion 14 on a support ledge 30. Supporting the latch 26 on the support ledge 30 blocks movement of the latch 26 from the locked position. The support ledge 30 is a type of support feature. Support features other than the support ledge 30 are contemplated.

Generally, the latch 26 includes an engagement portion 34 and a handle portion 38. The engagement portion 34 includes the portion of the latch 26 that fits within the annular groove 24 of the hinge pin 22 when the latch 26 is in the locked position. The portion of the latch 26 that fits within the annular groove 24 is part of a hemispherical section of the engagement portion 34 in this example.

The support ledge 30 supports the handle portion 38 when the latch 26 is in the locked position and in the position of FIGS. 2-5. In this position, the handle portion 38 is vertically above the support ledge 30. Vertical, for purposes of this disclosure, refers to the general orientation of the vehicle 2 during ordinary operation and with reference to ground G.

Figure 6:
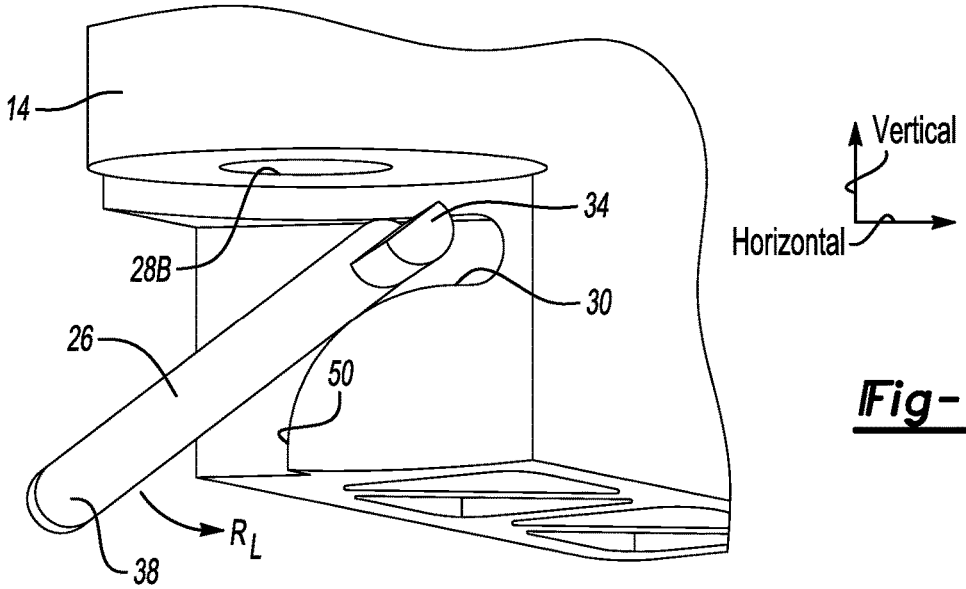
FIG. 6 illustrates the side view of the door portion and the latch from FIG. 5 with the hinge assembly transitioned from the closed position to a partially open position.
Figure 7:
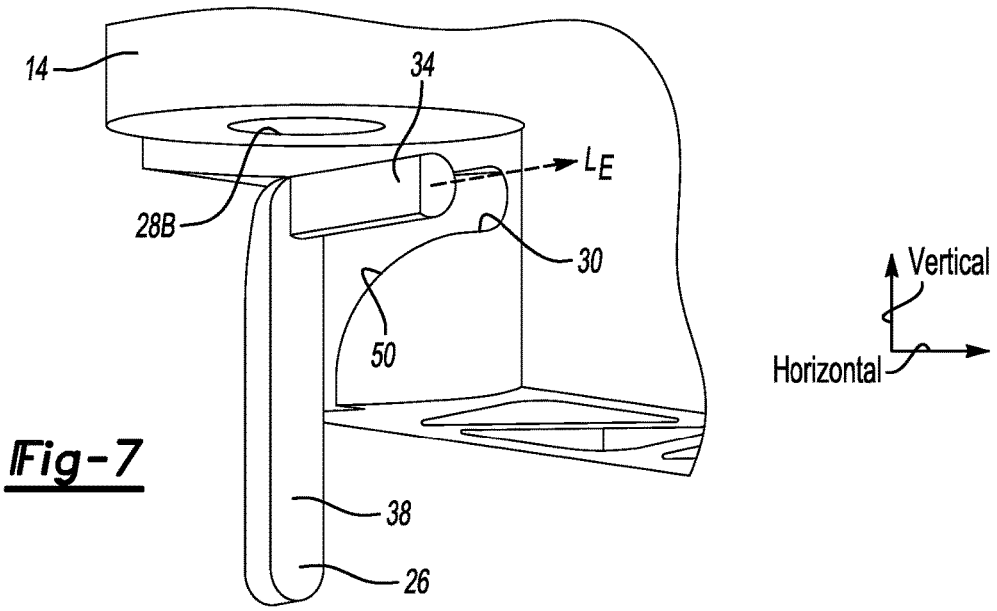
FIG. 7 illustrates the side view of the door portion and the latch from FIG. 6 with the hinge assembly transitioned from the partially open position of FIG. 6 to a more open position where the latch is in an unlocked position.
Figure 8:
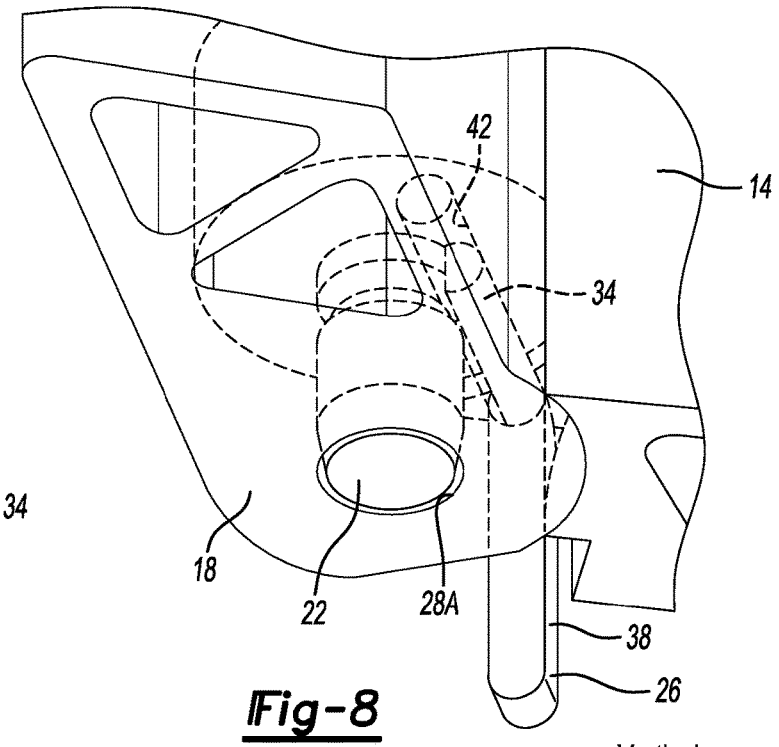
FIG. 8 illustrates the close-up view of the area of the hinge assembly in FIG. 3 when the hinge assembly is in the more open position of FIG. 7.
Figure 9:
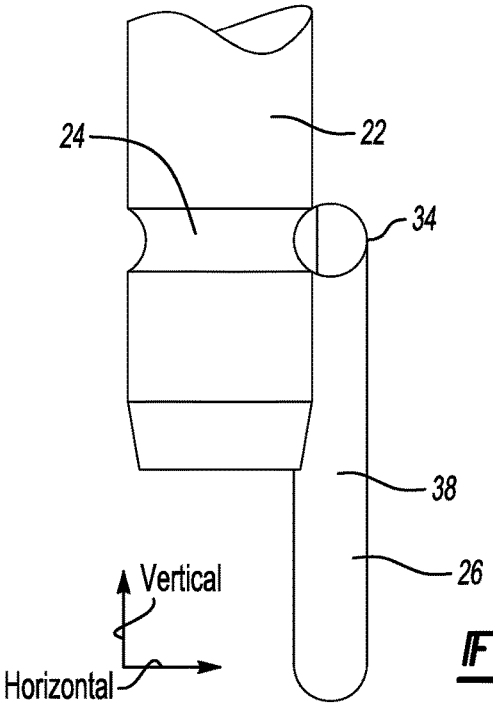
FIG. 9 illustrates a side view of a hinge pin and the latch from the hinge assembly of FIGS. 7 and 8.

Referring now to FIG. 6, as the hinge assembly 10 is opened, the support ledge 30 moves from beneath the handle portion 38. Gravity then causes the latch 26 to rotate downward until the latch 26 reaches the unlocked position of FIGS. 7-9. The rotation of the latch 26 is rotation in a direction $R_L$ about a longitudinal axis $L_E$ of the engagement portion 34.

As the latch 26 rotates in the direction $R_L$, the engagement portion 34 rotates within a bore 42 of the vehicle body portion 18. The rotation of latch 26 from the position of FIGS. 2-5 to the position of FIGS. 7-9 causes the engagement portion 34 to move from within the annular groove 24. The hinge pin 22 can then be withdrawn from the remaining portions of the hinge assembly 10 without being blocked by the engagement portion 34 of the latch 26.

To remove the door 4 (of FIG. 1) connected to the door portion 14 of the hinge assembly 10, the hinge pin 22 is moved vertically along the longitudinal axis A and removed from the hinge assembly 10. The door portion 14 and the door 4 can then be separated from the vehicle body portion 18 and the vehicle body 6.

In some examples, contaminants, such as mud or dirt, could adhere to the hinge assembly 10 and prevent the latch 26 from transitioning from the locked position to the unlocked position when the hinge assembly 10 is open. In such examples, after opening the door 4, a user can press the handle portion 38 in the direction $R_L$ to sever the bond between the latch 26 and the contaminants and thereby cause the latch 26 to move to the unlocked position of FIGS. 7-9.

Figure 9A:
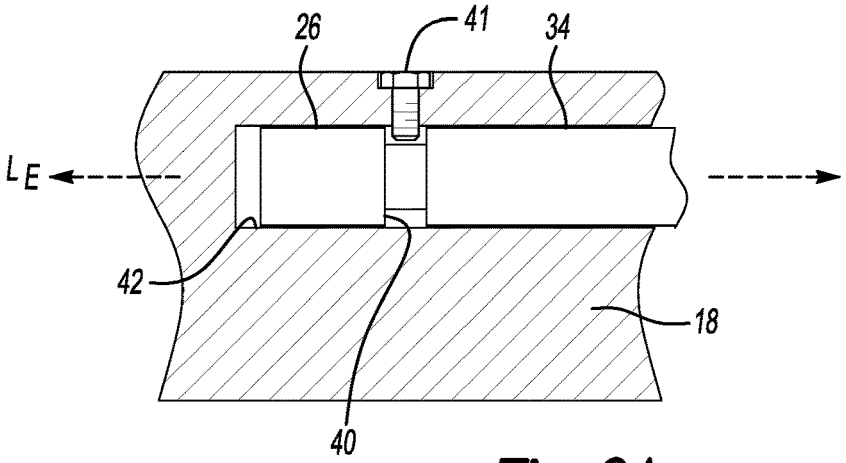
FIG. 9A illustrates a section view through an engagement portion of the latch when received within a bore of the hinge assembly according to variation of the embodiment.

In some examples, with reference to FIG. 9A, the engagement portion 34 of the latch 26 could include an annular groove 40 about the axis $L_E$. A set screw 41 or similar feature could extend through the vehicle body portion 18 into the annular groove 40 of the engagement portion 34 of the latch 26. The set screw 41 can block the engagement portion 34 of the latch 26 from backing out of the bore 42 of the vehicle body portion 18. The set screw 41 could extend into the annular groove 40 without pressing against the engagement portion 34, which could inhibit rotation of the engagement portion 34 within the bore 42 about the axis $L_E$.

If the door 4 is opened and not removed, the user can return the door 4 to the fully closed position of FIGS. 2-5. As the door 4 moves from the open position of FIGS. 7-9 to the closed position of FIGS. 2-5, the handle portion 38 rides along a ramp feature 50 formed within the door portion 14 of the hinge assembly 10. The ramp feature 50 acts as a cam that presses the handle portion 38 vertically upwards to rotate the latch 26 in a direction opposite the direction $R_L$ until the handle portion 38 of the latch 26 rests on the support ledge 30.

From time to time, the vehicle 2 may be in an orientation where removal of the doors 4 is not desired. For example, if the vehicle 2 flips such that the vehicle 2 rests on its roof rather than the wheels 8, removal of the doors 4 may not be desired.

In response to such orientations, the latch 26 of the exemplary embodiment automatically maintains to the locked position. Gravity, in the exemplary embodiment, prevents the handle portion 38 from rotating to a position where the engagement portion 34 is disengaged from the hinge pin 22. This blocks removal of the hinge pin 22 from the hinge assembly 10 by a user and blocks the hinge pin 22 from otherwise falling from the hinge assembly 10.

Figure 2:
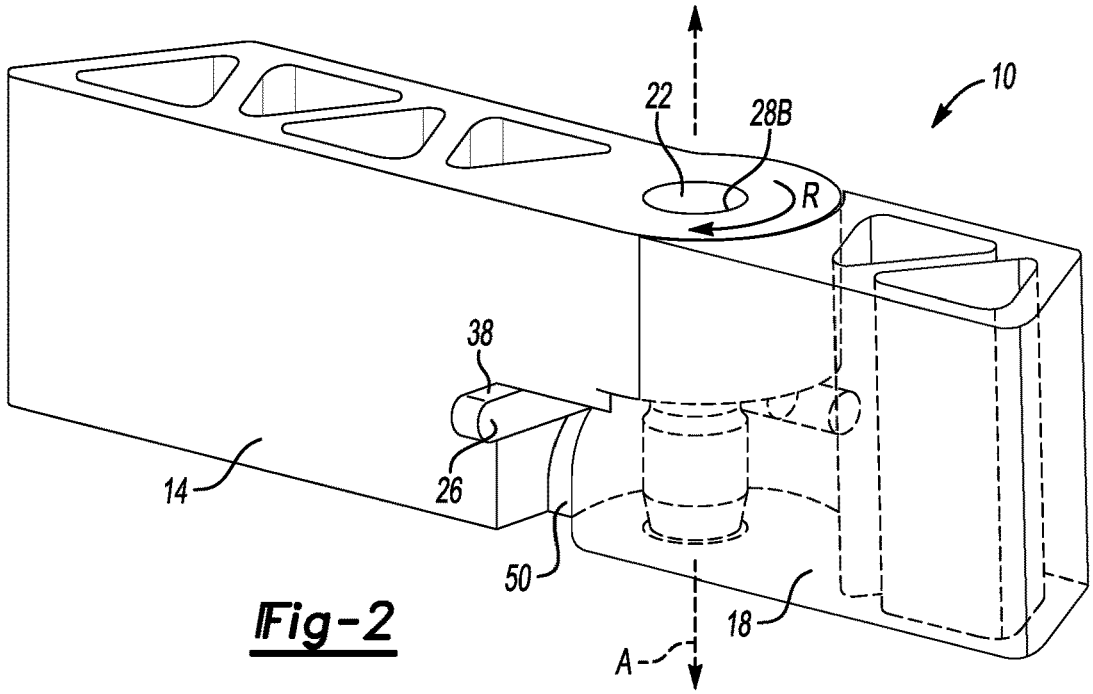
FIG. 2 illustrates a close-up view of a hinge assembly from a front side door of the vehicle of FIG. 1 according to an exemplary aspect of the present disclosure with the hinge in a fully closed position and in an orientation corresponding to ordinary operation of the vehicle.
Figure 3:
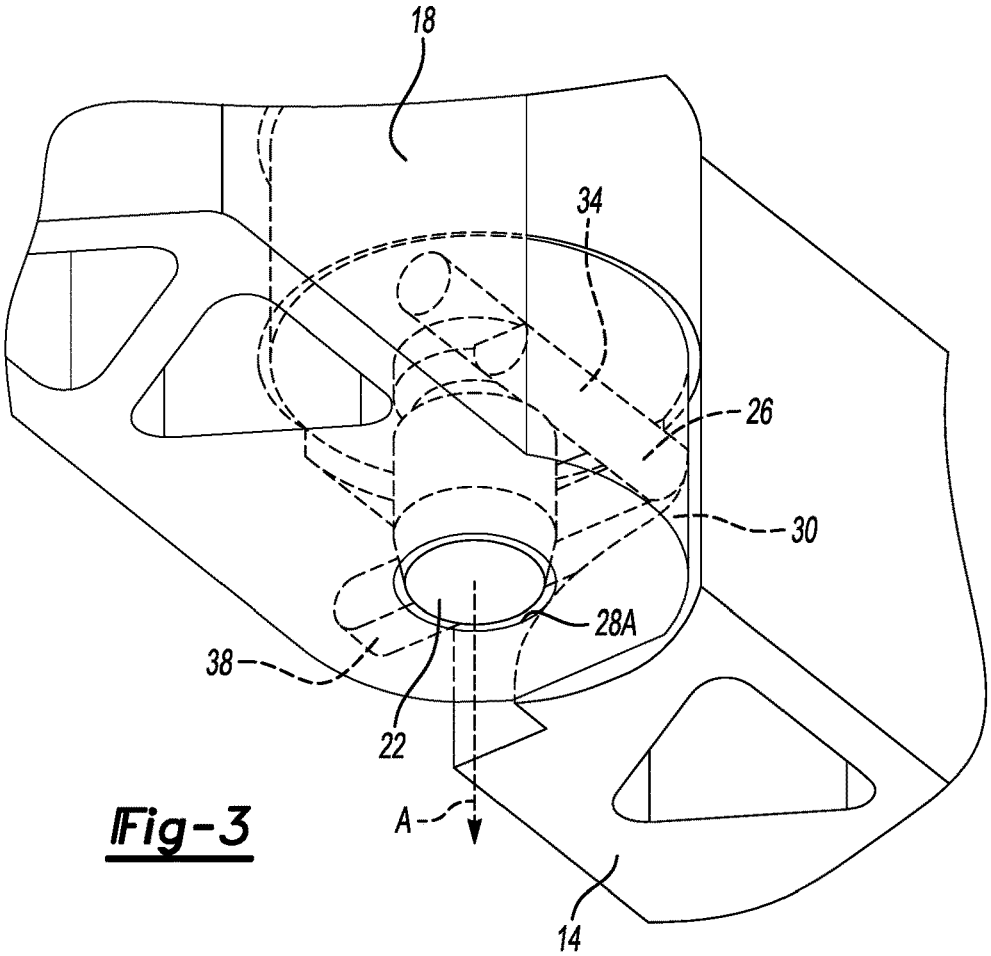
FIG. 3 illustrates a close-up view of an area of the hinge assembly in the fully closed position of FIG. 1 focused on a latch of the hinge assembly.
Figure 10:
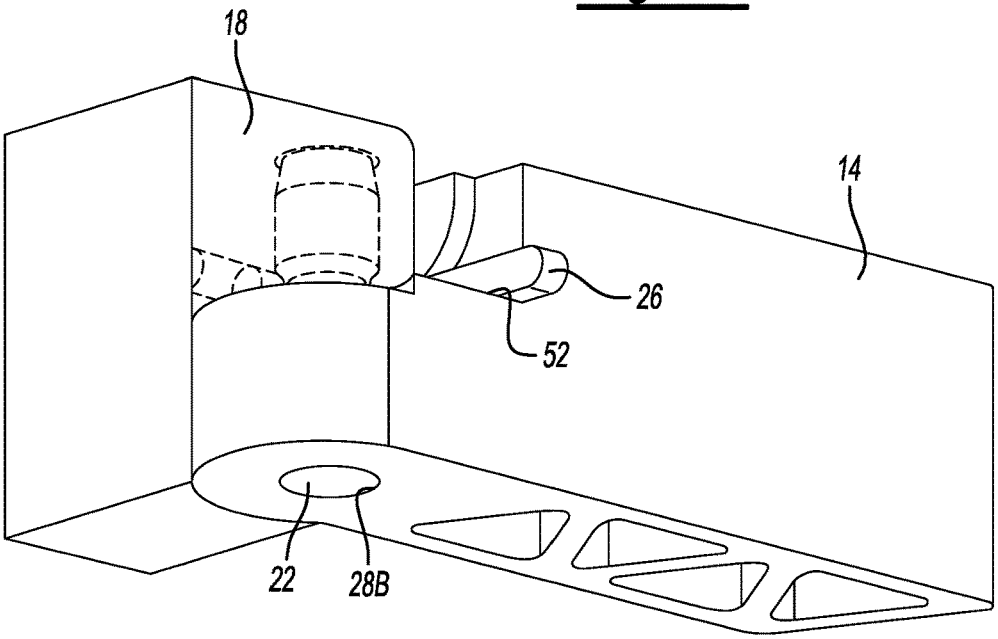
FIG. 10 illustrates the hinge assembly of FIG. 3 in an inverted and fully open position.
Figure 11:
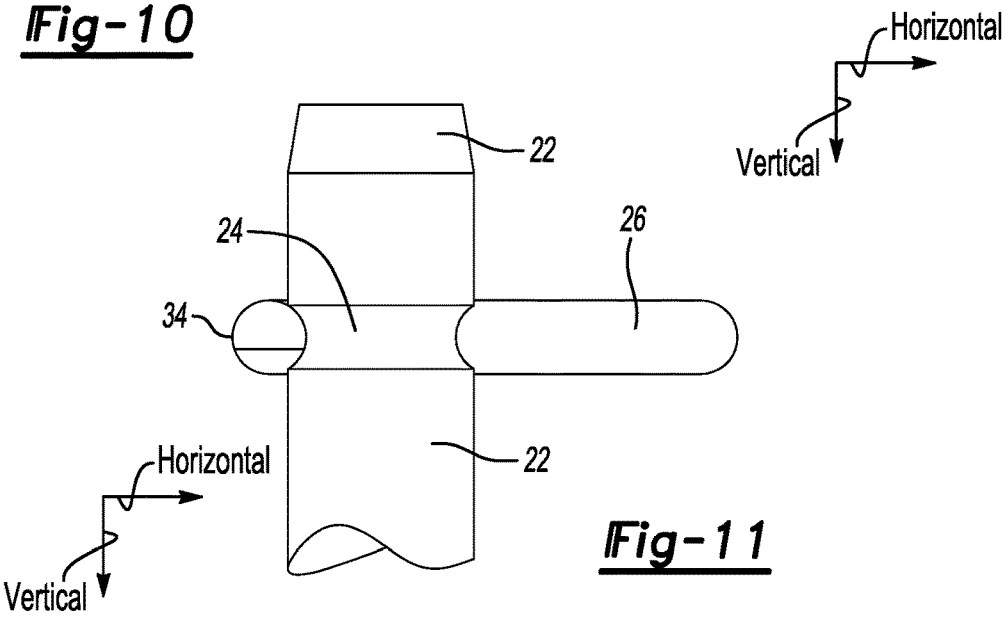
FIG. 11 illustrates a side view of a hinge pin and the latch from the hinge assembly of FIG. 10.

For example, with reference to FIGS. 10 and 11, the vehicle 2 of FIG. 2 has been reoriented such that the vehicle 2 rests on its roof. Accordingly, an orientation of the hinge assembly 10 with respect to ground G has also flipped and the hinge assembly 10 is inverted. In this position, gravity causes the latch 26 to rests in the locked position against a ledge 52 of the door portion 14 of the hinge assembly 10. The latch 26 resting in the locked position blocks the hinge pin 22 from falling or otherwise being removed from the other portions of the hinge assembly 10 such that the door 4 is decoupled from the vehicle 2.

Inverted, for purposes of this disclosure, is not limited to situations where the orientation of the hinge assembly 10 has flipped 180 degrees as shown in FIGS. 10 and 11. For example, the hinge assembly 10 could be considered inverted when the vehicle 2 of FIG. 1 is reoriented to rest on partially on a lateral side of the vehicle 2 and partially on a roof of the vehicle 2. After such a reorientation, the longitudinal axis A of the hinge pin 22 could have rotated, say, 160 degrees from the position of FIG. 2 yet still be considered inverted. Inverted can refer to any reorientation of the hinge assembly 10 causing the longitudinal axis of the hinge pin 22 to rotate from 90 to 180 degrees from the position of FIG. 2.

In this disclosure, like reference numerals designate like elements where appropriate, and reference numerals with the addition of one-hundred or multiples thereof designate modified elements. The modified elements incorporate the same features and benefits of the corresponding modified elements, expect where stated otherwise.

Figure 12:
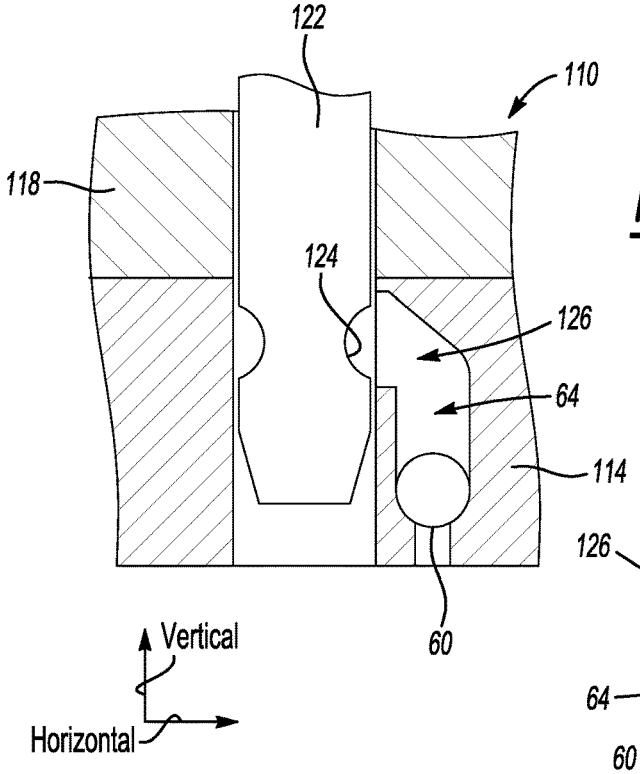
FIG. 12 illustrates a latch and a portion of a hinge assembly according to another exemplary aspect of the present disclosure when the latch is in an unlocked position.
Figure 13:
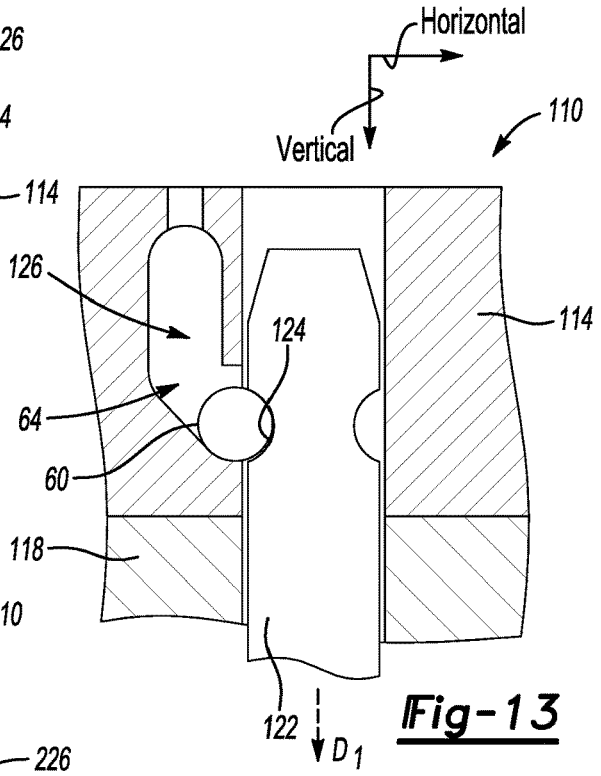
FIG. 13 illustrates the latch and the portion of the hinge assembly from FIG. 12 when the hinge assembly is inverted and the latch is in a locked position.

With reference now to FIGS. 12 and 13, a hinge assembly 110 according to another exemplary aspect of the present disclosure incorporates a latch 126. The latch 126 can include, among other things, a ball bearing 60 disposed within a cavity 64. The cavity 64 is at least partially provided by a door portion 114 of the hinge assembly 110 and at least partially provided by an annular groove 124 of a hinge pin 122. In another example, the cavity 64 could be at least partially provided by the vehicle body portion 118 and at least partially provided by the annular groove 124 of the hinge pin 122.

When the hinge assembly 110 is oriented as shown in FIG. 12 during ordinary operation of a vehicle, the ball bearing 60 falls to an area of the cavity 64 that is remote from the annular groove 124.

When the hinge assembly 110 is reoriented to the position of FIG. 13 such that the hinge assembly 110 is inverted, the ball bearing 60 moves, due to gravity, to an opposite end of the cavity 64 where the ball bearing 60 is at least partially received within the annular groove 124 of the hinge pin 122. The ball bearing 60 within the annular groove 124 blocks the hinge pin 122 from moving in a direction $D_1$ away from a position where the hinge pin 122 rotatably couples the door portion 114 of the hinge assembly 110 to a vehicle body portion 118 of the hinge assembly 110.

Figure 14:
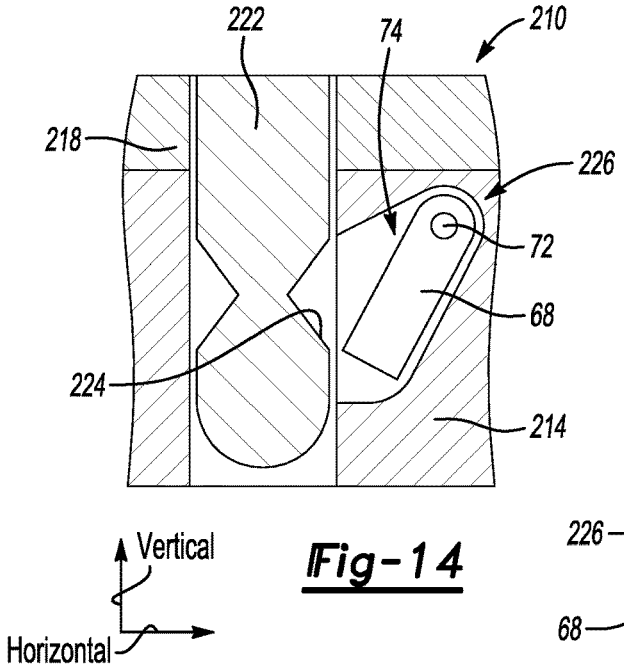
FIG. 14 illustrates a latch and a portion of a hinge assembly according to yet another exemplary aspect of the present disclosure when the latch is in an unlocked position.
Figure 15:
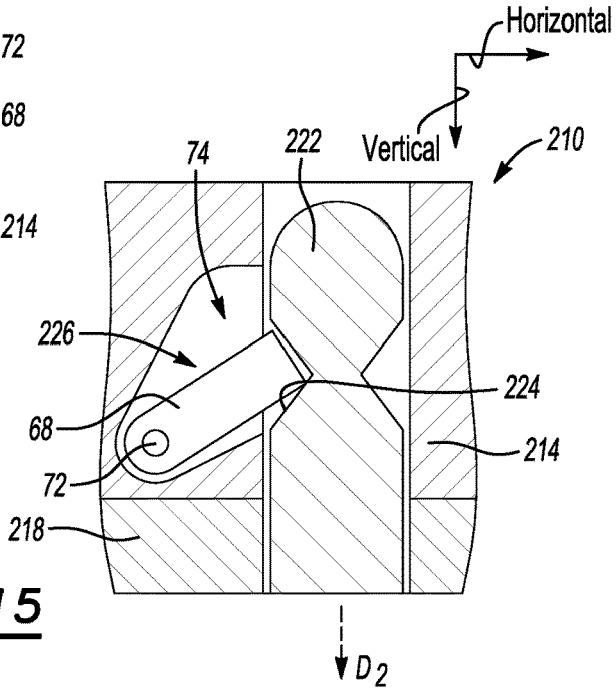
FIG. 15 illustrates the latch and the portion of the hinge assembly from FIG. 14 when the hinge assembly is inverted and the latch is in a locked position.

With reference now to FIGS. 14 and 15, a hinge assembly 210 according to another exemplary aspect of the present disclosure incorporates a latch 226. The latch 226 can include, among other things, a tab 68 secured to a pivot 72 within a cavity 74. The cavity 74 is at least partially provided by a door portion 214 of the hinge assembly 210, and at least partially provided by an annular groove 224 of a hinge pin 222. In another example, the cavity 74 could be at least partially provided by the vehicle body portion 218 and at least partially provided by the annular groove 224 of the hinge pin 222.

When the hinge assembly 210 is oriented as shown in FIG. 15 during ordinary operation of a vehicle, the tab 68 is pivoted about the pivot 72, due to gravity, to a position where the tab 68 is outside the annular groove 224 of the hinge pin 222. This permits the hinge pin 222 to withdrawn vertically upwards from the hinge assembly 210 to decoupled the door portion 214 of the hinge assembly 210 from the vehicle body portion 218 of the hinge assembly 210.

When the hinge assembly 210 is reoriented to the position of FIG. 14 such that the hinge assembly 210 is inverted, the tab 68 falls, due to gravity, to a position where a portion of the tab 68 is positioned within the annular groove 224 of the hinge pin 222. The tab 68, in this locked position, blocks the hinge pin 222 from moving in a direction $D_2$ away from a position where the hinge pin 222 rotatably couples the door portion 214 of the hinge assembly 210 to a body portion of the hinge assembly 210.

Figure 16:
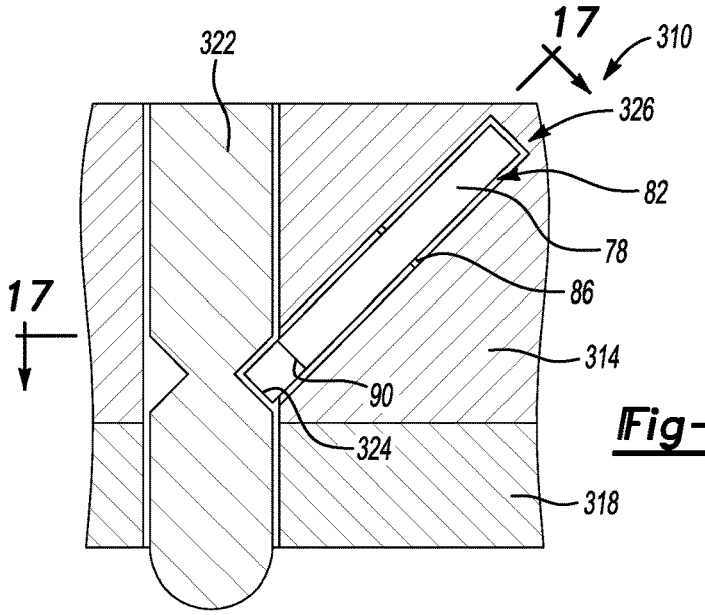
FIG. 16 illustrates a latch and a portion of a hinge assembly according to yet another exemplary aspect of the present disclosure when the latch is in an unlocked position.
Figure 17:
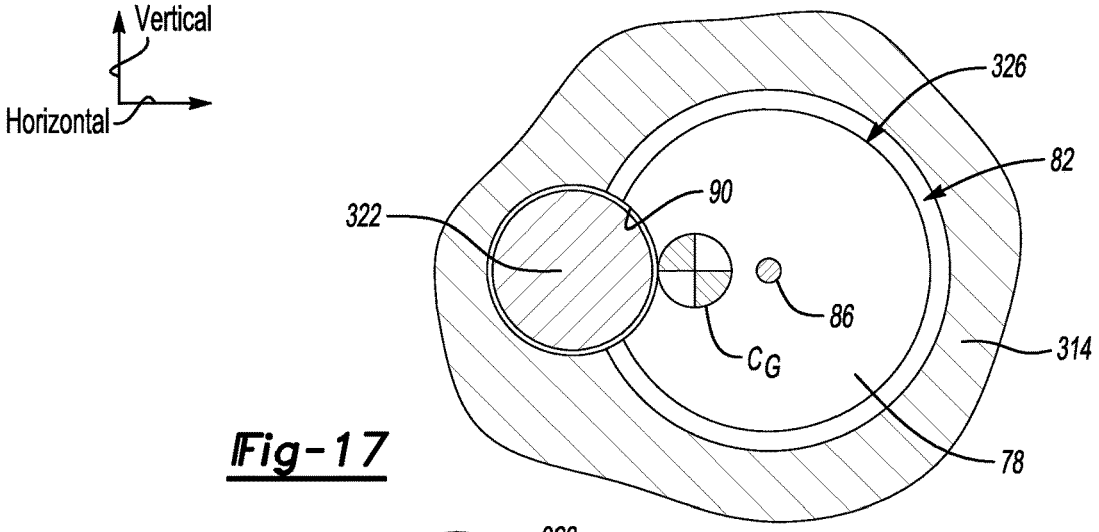
FIG. 17 illustrates a section view taken at line 17-17 in FIG. 16.
Figure 18:
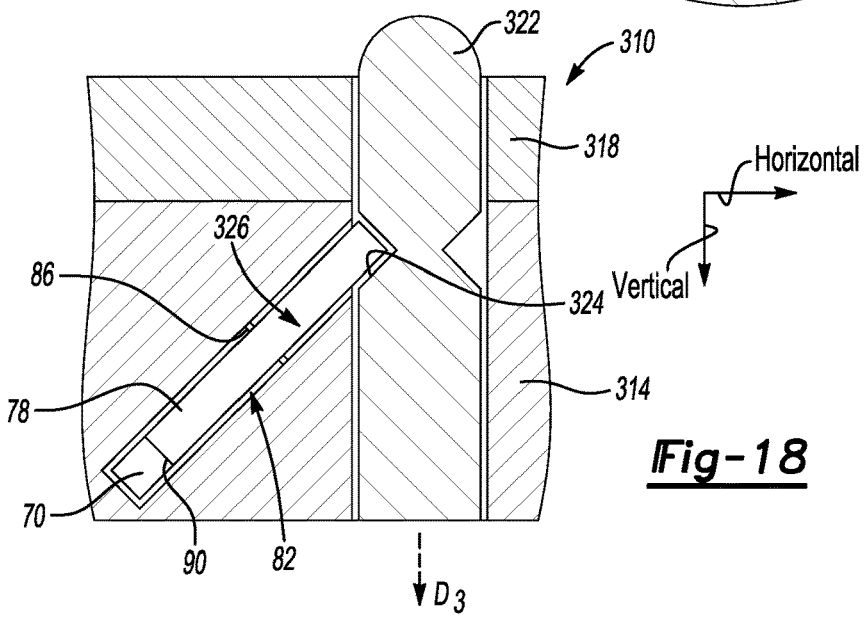
FIG. 18 illustrates the latch and the portion of the hinge assembly from FIG. 16 when the latch is in a locked position.

Referring now to FIGS. 16-18, a hinge assembly 310 according to still another exemplary aspect of the present disclosure, includes a latch 326. The latch 326 can include, among other things, an eccentric member 78 disposed within a cavity 82. The eccentric member 78 is rotatable about a pivot 86. The cavity 82 is at least partially provided by a door portion 314 of the hinge assembly 310 and at least partially provided by an annular groove 324 of a hinge pin 322. In another example, the cavity 64 could be at least partially provided by the vehicle body portion 318 and at least partially provided by the annular groove 324 of the hinge pin 322.

The eccentric member 78 can rotate within the cavity 82 about the pivot 86. A center of gravity $C_G$ of the eccentric member 78 is radially offset from the pivot 86. The center of gravity $C_G$ is circumferentially aligned with a notch 90 within the eccentric member 78. The center of gravity $C_G$ causes the eccentric member 78 to reorient around the rotational axis R as the hinge assembly 310 is reoriented with respect to ground.

The eccentric member 78 is configured such that, when the hinge assembly 310 is in the position of FIGS. 16 and 17, the notch 90 of the eccentric member 78 is aligned with a hinge pin the and, in particular, an annular groove 324 of the hinge pin 322. The offset center of gravity $C_G$ of the eccentric member 78 causes the notch 90 to circumferentially align about the pivot 86 with the annular groove 324 of the hinge pin 322.

When the hinge assembly 310 is reoriented to the position of FIG. 18, where the latch 326 is inverted, the eccentric member 78 rotates relative to the hinge assembly 10 about the pivot 86 such that an area of the eccentric member 78 is repositioned within the annular groove 324 of the hinge pin 322. The eccentric member 78 in this position, prevents the hinge pin 322 from moving in the direction $D_3$ to a disengaged position.

In another example, the eccentric member 78 and pivot 86 could be replaced with a pin that can slide within the cavity 82 in response to the hinge assembly 310 being reoriented.

Features of the disclosed examples include a latch that can move between a locked position that prevents the hinge pin of a hinge from being withdrawn to an unlocked position that permits withdrawal of the hinge pin. When the hinge pin is withdrawn, a door associated with the hinge can be removed from a vehicle. The latches are configured such that the latches maintain the locked position when the vehicle is oriented in a position where removing the door may be undesirable.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

What is claimed is:

1. A vehicle hinge assembly, comprising:

a door portion;

a body portion;

a hinge pin movable between an engaged position wherein the door portion and the body portion are rotatably coupled and a disengaged position wherein the door portion and the body portion are configured to be decoupled from one another; and a latch moveable between a locked position wherein the latch blocks movement of the hinge pin and an unlocked position wherein the latch allows movement of the hinge pin;

wherein when the hinge is in a first substantially upright orientation, the latch is configured to transition from the locked position to the unlocked position automatically when the door portion is rotated with respect to the body portion to an opened position; and wherein when the hinge is in a second substantially upside-down orientation, the latch is configured to stay in the locked position when the door portion is rotated with respect to the body portion to the opened position.

2. The vehicle hinge assembly of claim 1, wherein, when the hinge pin is in the engaged position, the door portion is rotatable with a door about the hinge pin between open and closed positions, when the door is fully closed and the hinge assembly is in the first substantially upright orientation, a support feature on the door portion of the hinge assembly supports and holds the latch in the locked position, wherein moving the door from the fully closed position to the open position moves the support feature away from the latch such that the latch can transition to the unlocked position.

3. The vehicle hinge assembly of claim 1, wherein the latch includes an engagement portion and a handle portion, the engagement portion received within a groove of the hinge pin when the latch is in the locked position to prevent withdrawal of the hinge pin from an aperture of the door portion of the hinge, an aperture of the body portion of the hinge, or both.

4. The vehicle hinge assembly of claim 1, wherein the second orientation is inverted from the first orientation.

5. A vehicle having a vehicle hinge assembly comprising:

a door portion;

a body portion;

a hinge pin movable between an engaged position wherein the door portion and the body portion are rotatably coupled and a disengaged position wherein the door portion and the body portion are configured to be decoupled from one another; and a latch moveable between a locked position wherein the latch blocks movement of the hinge pin and an unlocked position wherein the latch allows movement of the hinge pin;

wherein when the hinge is in a first substantially upright orientation, the latch is configured to transition from the locked position to the unlocked position automatically when the door portion is rotated with respect to the body portion to an opened position; and wherein when the hinge is in a second substantially upside-down orientation, the latch is configured to stay in the locked position when the door portion is rotated with respect to the body portion to the opened position;

wherein the first orientation corresponds to an ordinary orientation of the vehicle during operation.

* * * * *